US009720378B2

(12) United States Patent
Hills et al.

(10) Patent No.: US 9,720,378 B2
(45) Date of Patent: Aug. 1, 2017

(54) APPARATUS TO MONITOR CHRONOLOGICALLY THE TERM OF A PREGNANCY AND TO RECONFIGURE ITSELF TO CELEBRATE THE DATE BABY IS DUE

(71) Applicants: Craig A Hills, Tempe, AZ (US); David A. Fussell, Flagler Beach, FL (US)

(72) Inventors: Craig A Hills, Tempe, AZ (US); David A. Fussell, Flagler Beach, FL (US)

( * ) Notice: Subject to any disclaimer, the term of this patent is extended or adjusted under 35 U.S.C. 154(b) by 0 days.

(21) Appl. No.: 14/998,804

(22) Filed: Feb. 18, 2016

(65) Prior Publication Data

US 2016/0238995 A1 Aug. 18, 2016

Related U.S. Application Data

(60) Provisional application No. 62/176,440, filed on Feb. 18, 2015.

(51) Int. Cl.

| | |
|---|---|
| ***G04B 45/00*** | (2006.01) |
| ***G04B 47/04*** | (2006.01) |
| ***G04C 23/04*** | (2006.01) |
| ***G04F 1/00*** | (2006.01) |
| ***G04G 15/00*** | (2006.01) |

(52) U.S. Cl.

CPC ..... *G04B 45/0069* (2013.01); *G04B 47/04* (2013.01); *G04B 47/046* (2013.01); *G04C 23/04* (2013.01); *G04F 1/00* (2013.01); *G04F 1/005* (2013.01); *G04G 15/003* (2013.01)

(58) Field of Classification Search

CPC .. G04B 7/04; G04B 7/046; G04F 1/00; G04F 1/005

USPC ..... 368/10, 107, 108, 110–113, 272, 285; D10/7, 40; 446/71, 76, 487

See application file for complete search history.

(56) References Cited

U.S. PATENT DOCUMENTS 1,041,177 A * 10/1912 Schmidt ..... G04B 25/06 368/272
2,705,387 A * 4/1955 Handler ..... A63H 5/00 446/151
3,768,175 A * 10/1973 Hill ..... G09B 1/06 434/348
4,453,340 A * 6/1984 Kozuka ..... A63H 17/40 446/288

(Continued)

OTHER PUBLICATIONS

Poppy Chick Egg Alarm Clock Timer, Mar. 8, 2012, Retrieved Jul. 21, 2016 from <http://chinagift.en.ecplaza.net/poppy-chick-egg-alarm-clock--151032-2138517.html>, full document.*

*Primary Examiner* — Amy Cohen Johnson
*Assistant Examiner* — Daniel Wicklund
(74) *Attorney, Agent, or Firm* — Tod R. Nissle, P.C.

(57) ABSTRACT

A chronometer to monitor the passage of time prior to a projected date of birth of a baby and to recognize and celebrate the birth of the baby. The chronometer includes a generally hollow egg-shaped housing including a bottom, a top, a hinge mechanism, and a latching mechanism. The hinge mechanism rotatably connects the top to the bottom so the top can open and close. The latching mechanism releasably connects the top to the bottom. The chronometer also includes a replica of a young chicken housed in the chronometer, and includes a display to indicate the length of time until the projected birth date of the baby.

1 Claim, 5 Drawing Sheets

(56) References Cited

U.S. PATENT DOCUMENTS

| | | | | |
|---|---|---|---|---|
| 4,912,586 | A * | 3/1990 | Herron | G04B 19/21 368/223 |
| 5,652,736 | A * | 7/1997 | Lee | G04B 47/04 368/278 |
| D432,431 | S * | 10/2000 | Robinson | D10/2 |
| 6,231,346 | B1 * | 5/2001 | Sagi-Dolev | G09B 19/00 434/225 |
| 6,600,696 | B1 * | 7/2003 | Lynn | A61B 10/0012 368/10 |
| 7,132,925 | B2 * | 11/2006 | Johnson | A47G 29/141 340/12.52 |
| 2003/0230124 | A1 * | 12/2003 | Johnson | A47G 29/141 70/267 |
| 2004/0252588 | A1 * | 12/2004 | Lee | G04B 45/0069 368/19 |
| 2004/0259466 | A1 * | 12/2004 | Maxwell | A63H 33/042 446/487 |
| 2006/0039241 | A1 * | 2/2006 | Forbath | G04F 10/00 368/110 |
| 2007/0049162 | A1 * | 3/2007 | Liao | A63H 5/00 446/487 |
| 2010/0149925 | A1 * | 6/2010 | Cheng | G04F 1/005 368/109 |

* cited by examiner

APPARATUS TO MONITOR CHRONOLOGICALLY THE TERM OF A PREGNANCY AND TO RECONFIGURE ITSELF TO CELEBRATE THE DATE BABY IS DUE

This application claims priority based on provisional patent application Ser. No. 62/176,440, filed Feb. 18, 2015.

This invention pertains to chronometers.

More particularly, the invention pertains to a chronometer for monitoring pregnancy.

Those of skill in the art have for many years pursued designing improved apparatus to monitor the passage of time and recognition of events of note.

Accordingly, it would be advantageous to produce an improved chronometer.

I heretore, it is a principal object of the invention to provide an improved apparatus for use in conjunction with a pregnancy and the date of birth of a baby at the conclusion of the pregnancy.

This, and other and further objective of the invention will be apparent to those skilled in the art based on the following detailed description thereof, taken in conjunction with the drawings, in which.

Briefly, in accordance with the invention, provided is an improved chronometer. The chronometer monitors the passage of time prior to a projected date of birth of a baby and recognizes and celebrates the birth of the baby. The chronometer comprises a generally hollow egg-shaped housing. The housing includes a bottom; a top; and a hinge mechanism rotatably connecting the top to the bottom such that the top moves between at least two operative positions, an open position and a closed position. The housing also includes a latching mechanism releasably connecting the top to the bottom. The chronometer also includes a replica of a young chicken mounted in the housing; and a microprocessor mounted in the housing. The microprocessor is programmable with the time remaining until the projected birth date of a baby, and to activate the latching mechanism on the projected birth date to permit the top to move from the closed position to the open position. The chronometer also includes a display operatively associated with the microprocessor to reflect the length of time until the projected birth date of a baby.

In another embodiment of the invention an improved chronometer is provided. The chronometer monitors the passage of time prior to a projected date of birth of a baby and recognizes and celebrates the birth of the baby. The chronometer comprises a generally hollow egg-shaped housing including a bottom, a top, and a hinge mechanism. The hinge mechanism rotatably connects the top to the bottom such that the top moves between at least two operative positions, an open position, and a closed position. The chronometer also includes a replica of a young chicken mounted in the housing; a microprocessor mounted in the housing and programmable with the time remaining until the projected birth date of a baby; and, a display operatively associated with the microprocessor to indicate the length of time until the projected birth date of a baby.

In a further embodiment of the invention, an improved method is provided to recognize and celebrate a future event. The method includes the step of providing a chronometer to monitor the passage of time prior to the date of the future event. The chronometer comprises a generally hollow housing including a bottom, a top, and a hinge mechanism. The hinge mechanism rotatably connects the top to the bottom such that the top moves between at least two operative positions, an open position, and a closed position. The chronometer also includes an article mounted in the housing; a microprocessor mounted in the housing and programmable with the time remaining until the projected birth date of the event; and a display operatively associated with the microprocessor to indicate the length of time until the date of the event. The method also includes the steps of programming the microprocessor with the date of the event; and, moving the top to the open position on or near the date of the event to reveal the article.

Figure 1:
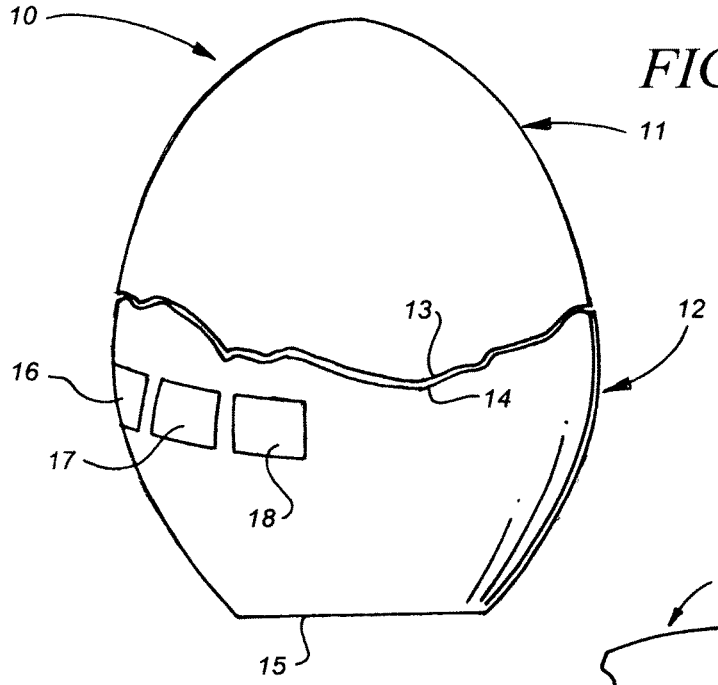
FIG. 1 is a side view illustrating a chronometer constructed in accordance with the principles of the invention.

Turning now to the drawings which describe the presently preferred embodiments by way of illustration and not limitation of the invention, and in which like reference characters refer to corresponding elements throughout the several views, FIG. 1 illustrates a chronometer 10 to monitor the passage of time prior to a projected date of birth of a baby and to recognize and celebrate the birth of the baby. The chronometer 10 comprises a generally hollow egg-shaped housing including a bottom 12, and a top 11. Top 11 includes circumferential edge 13 which conforms to and contacts the circumferential edge 14 of bottom 12. Edges 13 and 14 co-terminate with each other to produce the appearance of a "crack" which extends completely around the periphery of the egg-shaped housing.

Display windows 16, 17, 18 are formed in bottom 12. As will be described, windows 16 to 18 (or another display) indicate the period of time preceding a projected due date in a pregnancy. For example, if the projected birth date is 242days from when the chronometer is programmed, then the chronometer is programmed so that initially the numeral "2" appears in window 16, the numeral "4" appears in window 17, and the number "2" appears in window 18. Microprocessor 25 causes the chronometer subsequently to automatically count down and display the days, one day at a time, until the projected birth day. Consequently, the day after the chronometer is originally programmed with the number "242", microprocessor 25 causes the number "241" to appear in windows 16, 17, 18, i.e., window 16 shows the numeral "2", the window 17 shows the numeral "4", and the window 18 shows the number "1". This count down continues until on the projected day of birth, each window 16, 17, 18 displays the numeral "0".

Alternatively, windows can indicate the period of time preceding a projected birth date by simply showing the projected birth date. If the projected date is Aug. 22, 2016, then window 16 shows the numeral "8" (for the month August), window 17 shows the numerals "22", and window 18 shows the numeral "16". In this case, the chronometer does not sequence through a count down. The projected date continues to be displayed in windows 16 to 18 until the day of birth. While chronometer 10 need not include one or more displays 16, 17, 18 and 21, the use of such a display(s) is presently preferred and deemed to be an important feature of the invention.

Figure 2:
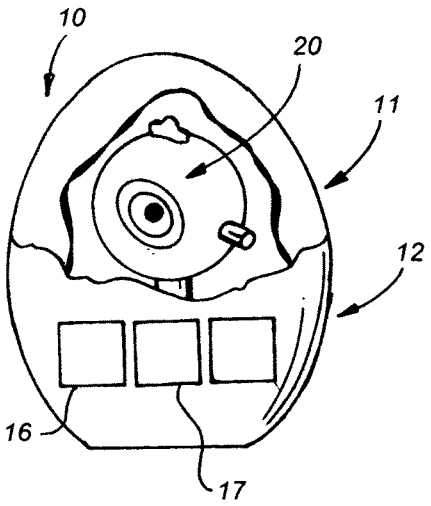
FIG. 2 is a side view of the chronometer of FIG. 1 illustrating additional features thereof.

In FIG. 2, replica 20 of a young chicken is housed in chronometer 10. Replica 20 can be permanently mounted in chronometer 10, but presently preferably comprises a free standing unit which includes a body 22 and base 23 (FIG. 5) and can be removed from the chronometer 10 and set on a table top in the upright orientation depicted in FIGS. 2 and 5.

Replica 20 can, if desired, be replaced by another article related to the birth of a baby or related to another event that is being monitored and celebrated with the chronometer of the invention. Two or more replicas 20 or other articles (the same as each other or different from each other) can be housed in chronometer 10.

Figure 3:
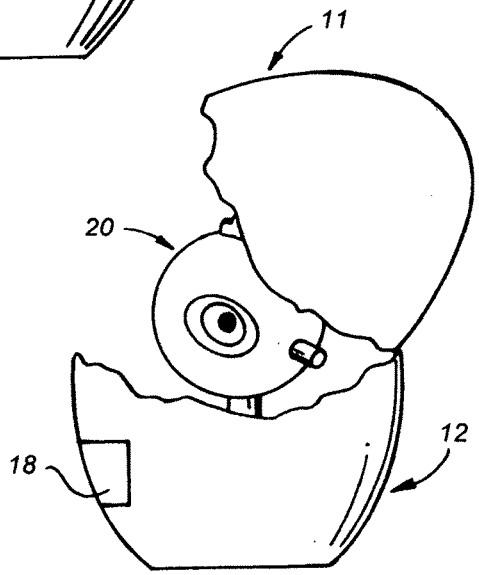
FIG. 3 is a side view of the chronometer of FIG. 1 illustrating the chronometer in a partially open configuration.

FIG. 3 illustrates the top 11 of chronometer 10 in a partially opened configuration. Although not shown or visible in FIG. 3, a spring-loaded hinge mechanism interconnects top 11 and bottom 12. The hinge mechanism, along with a latching mechanism, is used to move top 11 between the closed configuration of FIGS. 1 and 2 and the open configurations illustrated in FIGS. 3, 4 and 6. When chronometer 10 is in the closed configuration illustrated in FIG. 1, top 11 and bottom 12 cooperatively enclose an interior space 54 (FIGS. 4 to 7).

Figure 4:
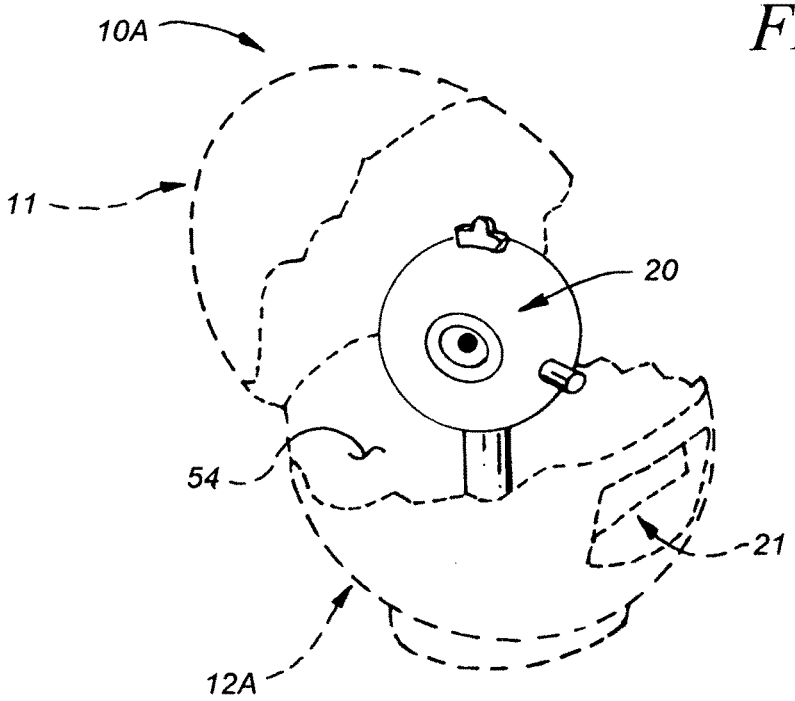
FIG. 4 is a perspective view of a chronometer comparable to the chronometer of FIG. 1 and illustrating the chronometer in an open configuration.

FIG. 4 depicts a chronometer 10A which is substantially identical to chronometer 10, with the exception that shape and dimension of bottom 12A is somewhat different from bottom 12, and the display 21 comprises a single elongate screen instead of three separate display screens 16, 17, 18.

Figure 5:
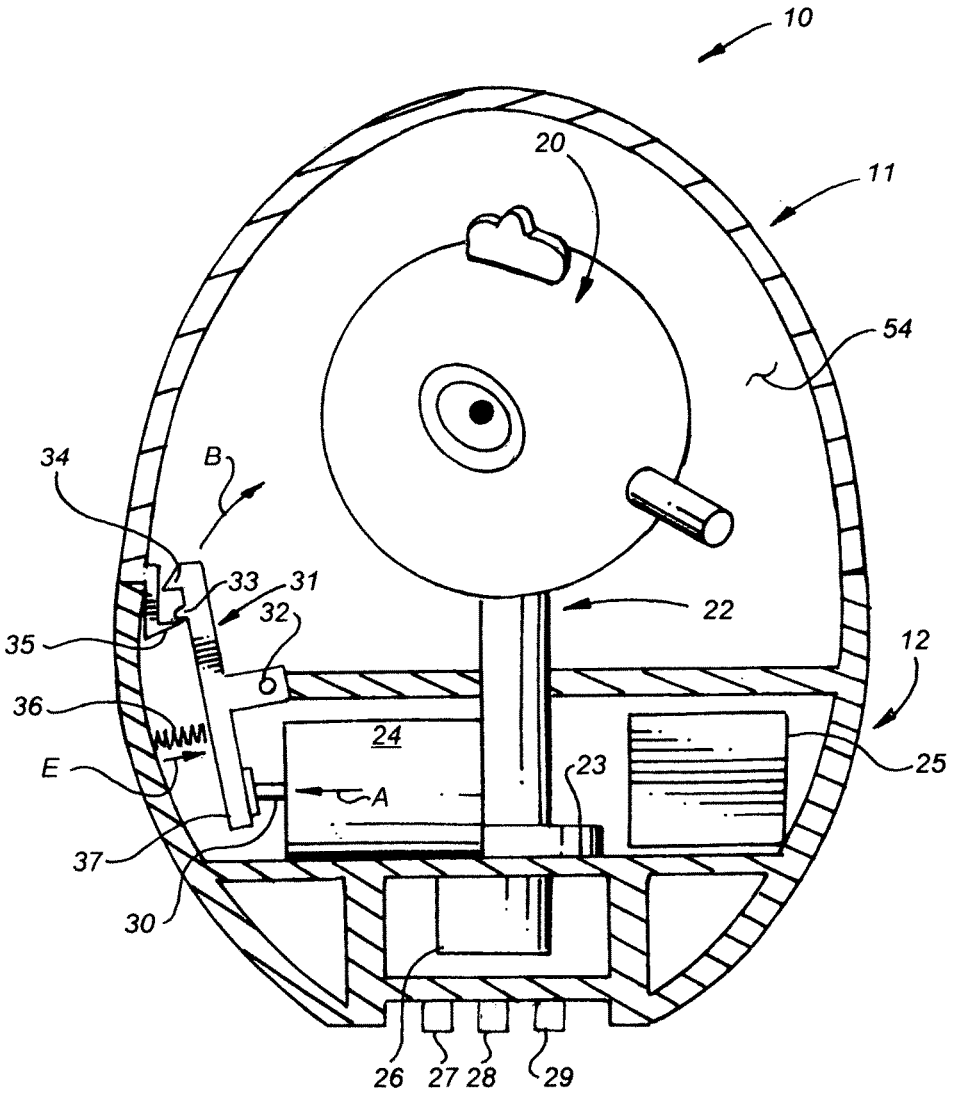
FIG. 5 is a section view of the chronometer of FIG. 1 illustrating interior construction details thereof.

As is shown in FIG. 5, chronometer 10 includes a microprocessor 25, battery unit 26, and control buttons 27, 28, and 29.

Chronometer 10 also includes a latching mechanism including plunger unit 24, arm 31 pivotally mounted on pin 32, spring 36, and tip 35 fixedly secured to top 11. The latch mechanism operates to move arm 31 between the engaged position shown in FIG. 5 and a disengagement position in which the top of arm 31 and tooth 34 at the top of arm 31 are displaced in the direction of arrow B.

In FIG. 5, plunger 30 is shown in its normal operative position contacting the bottom 37 of arm 31. Compressed spring 36 continuously attempts to expand and, therefore, continuously applies a force against arm 31 which acts in the direction of arrow E and which normally functions to maintain arm 31 in the engaged position shown in FIG. 5. When arm 31 is in the position shown in FIG. 5 and when top 11 is closed, tip 35 extends beneath and engages tooth 33 on arm 31; and, therefore, tooth 33 prevent tip 35 from moving upwardly. If tip 35 can not move upwardly, top 11 is prevented from moving from the closed position of FIGS. 1 and 2 to the open position of FIG. 6.

When, during the operation of chronometer 10, the time (such as the projected date of birth of a baby) comes for top 11 to open, or begin to open, microprocessor 25 activates plunger unit 24 such that unit 24 extends plunger 30 a selected distance in the direction of arrow A. Extending plunger 30 in the direction of arrow A functions to move the bottom 37 of arm 31 in the general direction of arrow A, causing arm 31 to pivot about pin 32 and move the top of arm 31 and tooth 34 in the direction of arrow B. This pivoting of arm 31 about pin 32 also compresses spring 36 and disengages tip 35 from beneath tooth 33. When tip 35 is disengaged from tooth 33, it moves upwardly. This upward movement is caused by the spring-loaded hinge mechanism which is referred to above and which is described in more detail below with reference to FIGS. 6 and 7. Plunger 30 is, however, moved in the direction of arrow A through a distance which is sufficient only to disengage tip 35 from tooth 33 and allow it to move upwardly to engage the bottom of tooth 34. As a result, this permits top 11 to begin to open but does not permit top 11 to open completely to the position shown in FIG. 6. This limited movement typically occurs, for example, a day to two before the projected birth date. On the actual birth date, microprocessor 25 (or some other control mechanism) against activates plunger unit 24 such that plunger 30 is moved in the direction of arrow A a distance sufficient to pivot the top of arm 31 and tooth 34 in the direction of arrow to disengage tip 35 from tooth 34 so top 11 is free to fully open to the position shown in FIG. 6. In some embodiments of the invention, tooth 34 is omitted so that once tip 35 disengages from tooth 33, top 11 is free to open completely to the position shown in FIG. 6. In other embodiments of the invention, there are, instead of two teeth 33 and 34, three or more teeth so that top 11 can gradually open through two or more positions prior to top 11 completely opening to the orientation shown in FIG. 6. Any desired mechanism or apparatus can, of course, be integrated in chronometer 10 or utilized in conjunction with the latch mechanism of FIG. 5 to releasably engage top 11 so that top 11 can open through a series of positions or can completely open on the projected date of birth.

Unit 24 can be a proportional solenoid, includes gears, or be constructed in any desired fashion to move plunger 30 as required.

Figure 6:
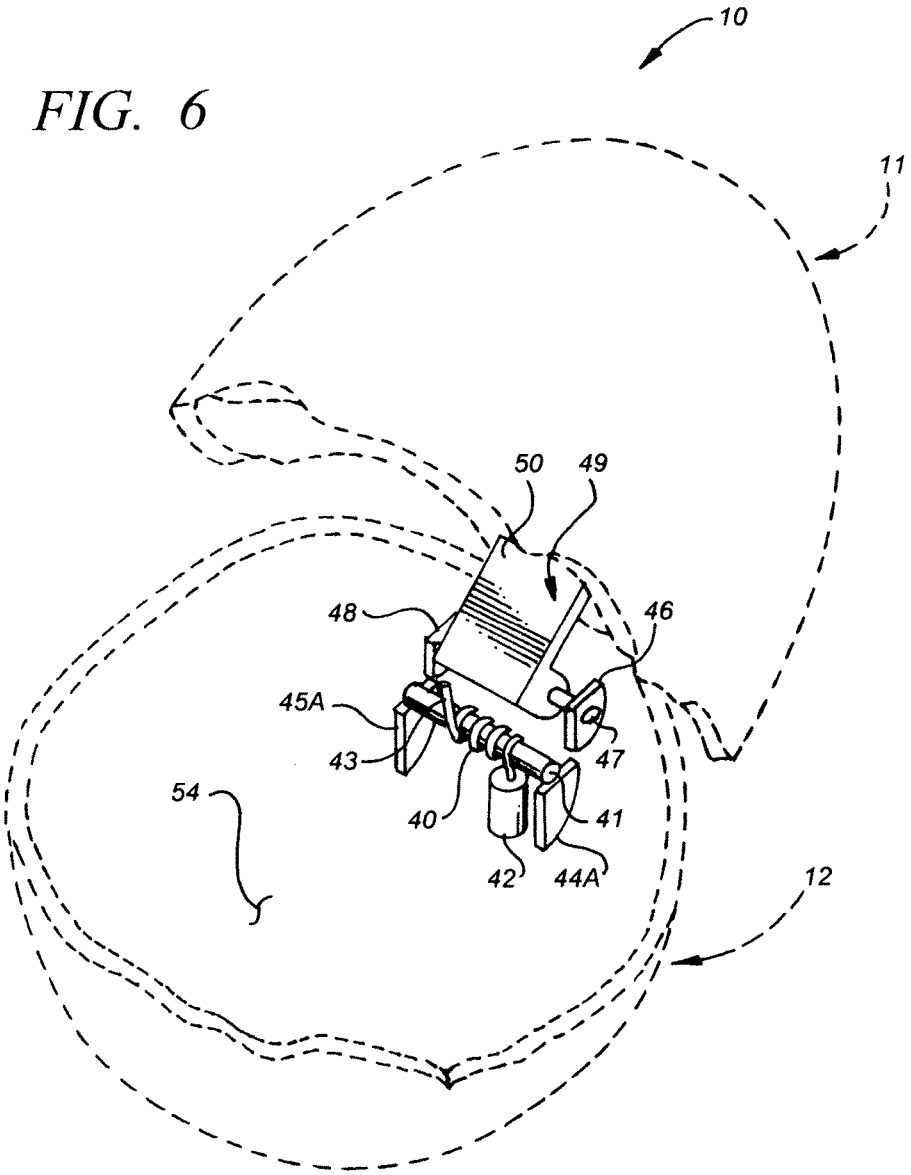
FIG. 6 is a perspective view of the chronometer of FIG. 1 in an open configuration and illustrating the spring loaded hinge mechanism which functions to open the chronometer; and, FIG. 7 is a side section view of a chronometer housing further illustrating the spring loaded hinge mechanism of FIG. 6 when the housing is in a closed configuration.

As earlier noted, the latch mechanism of FIG. 5 works in conjunction with a spring-loaded hinge mechanism. This hinge mechanism is not, for sake of clarity, shown in FIG. 5 but rather is illustrated in 6 and 7. The hinge mechanism interconnects top 11 and bottom 12 and includes a spring 40 slidably rotatable mounted on a pin, or rod, 41. The ends of rod 41 are each fixedly mounted in a different one of upstanding panel members 44 (FIG. 7), 45 (not shown) which are fixedly attached to the inner wall of bottom 12. In FIG. 6, only the bottom portions 44A and 45A of panel members 44, 45 are—for the sake of clarity—shown. Generally U-shaped member 49 is pivotally mounted on rod 47. The ends of rod 47 are fixedly mounted in upstanding panel members 46 and 48. Panel members 46 and 48 are fixedly mounted to the interior of bottom 12. Member 49 includes sides, or surfaces, 50 and 52.

End 51 of member 49 is fixedly secured to the inner surface of top 11. As a result, when member 49 pivots about rod 47, top 11 rotates simultaneously with member 49.

Figure 7:
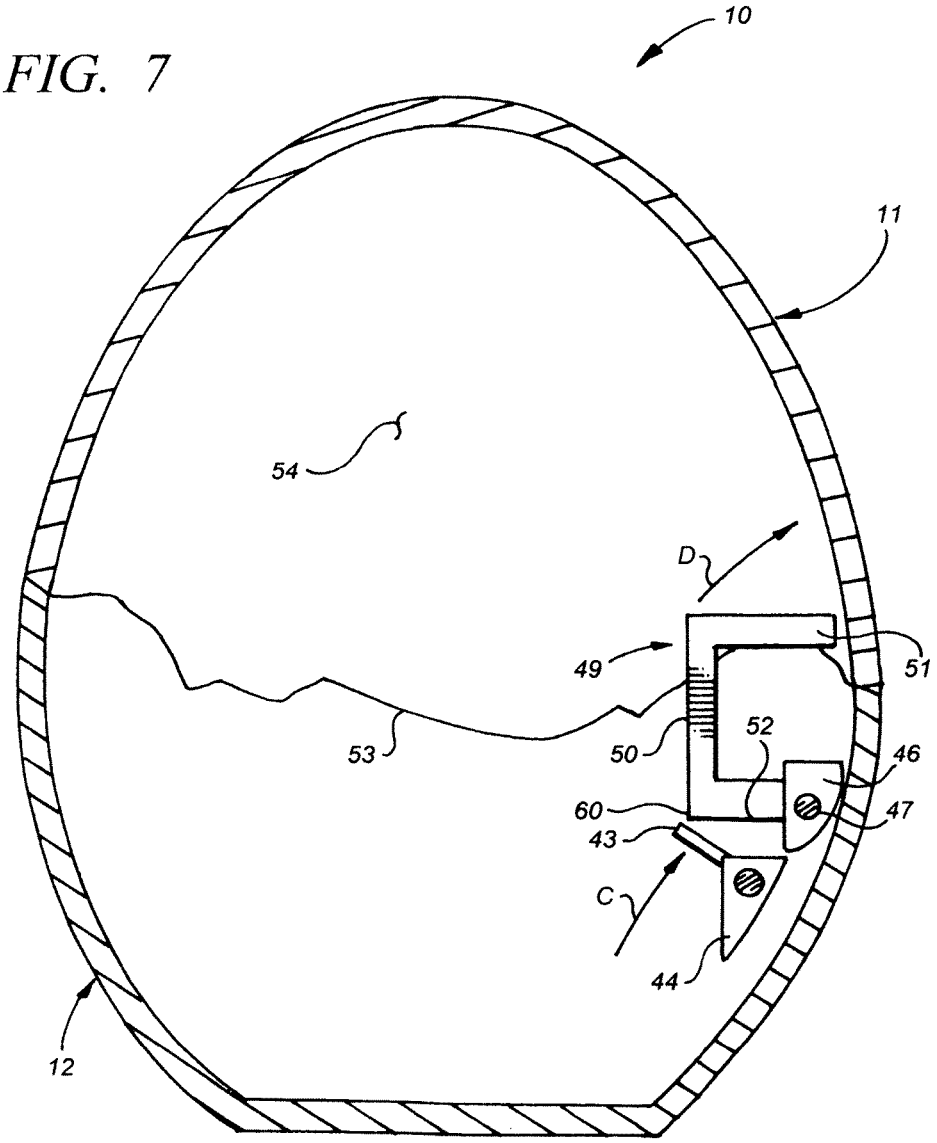

When top 11 is closed then, as shown in FIG. 7, end 43 of spring 40 bears against surface 52 or the corner at which surfaces 50 and 62 co-terminate, and generates a force in the direction of arrow C which acts to displace member 49 and to pivot member 49 about rod 47 in the direction of arrow D. Such pivoting of member 49 about rod 47 is, as can be seen in FIG. 5, prevented when tip 35 extends beneath and engages a tooth 33 or 34. Displacing plunger in the direction of arrow A to disengage tooth 33 and/or tooth 34 from tip 35 permits top 11 and member 49 to pivot in the direction of arrow D in FIG. 7.

In FIG. 6, member 49 has been "pushed" or pivoted to a position in which top 11 is open. This releases the "wound up energy" which exists in spring 40 when top 11 is closed. In FIG. 6, spring 40 has "unwound" and end 43 has moved to a substantially upright position. In contrast, in FIG. 7, member 49 has contacted and pushed and displaced end 43 downwardly to a more horizontal orientation. This downward displacement "winds" or "coils" spring 40 into a position in which end 43 presses upwardly against edge 60 and generates a force acting to move member 49 in the direction of arrow D. Such movement of member 49 (and top 11) is, as noted, prevented when tip 45 engages a tooth 33 or 34. Any desired mechanism can be integrated in chronometer 10 or used in conjunction with the hinge mechanism of FIGS. 6 and 7 to permit top 11 to remain closed until the appointed date(s) and to open partially or completely on the appointed date(s).

Control button 27 is configured such that when it is pushed it opens the latch mechanism (i.e., displaces arm 31 in the direction of arrow B to disengage arm 31 completely from tip 35), and permits top 11 to open.

Button 28 is used to enter data in microprocessor 25 or some other control mechanism. Button 29 can also be used to enter data in microprocessor 25 or for any other desired function.

In use, chronometer 10 is placed in the closed configuration of FIG. 1. The projected due date of a baby is determined and is entered into microprocessor 25 using button(s) 28, 29. Microprocessor 25 causes the time remaining before the baby's due date to appear on displays 16, 17, 18 or 21. If the number of days to the projected birth date is calculated to be 237, then the numeral "2" appears on display 16, the numeral "3" appears on display 17, and the numeral "7" appears on display 18. Chronometer 10 counts down day-by-day, one day at a time, until the projected date of birth is reached. On the projected date of birth, displays 16 to 18 each show the numeral "0", at which time microprocessor 25 activates plunger unit 24 to displace plunger 30 to pivot arm 31 from the engaged position of FIG. 5 to disengage teeth 33 and 34 from tip 35 such that top 11 opens to the position depicted in FIG. 6 to reveal replica 20. If desired, replica 20 can be removed from chronometer 10 and set upright on a table top or other horizontally oriented surface.

In an alternate embodiment of the invention, the latch mechanism is eliminated and the hinge mechanism is not spring-loaded. The hinge mechanism simply pivotally interconnects top 11 and bottom 12 just as a conventional door hinge pivotally interconnects one vertical edge of a door with one vertical side of the door frame. The door frame extends along the sides and top of the door. In this embodiment of the invention, top 11 is manually grasped and pivoted from the closed position of FIG. 1 to the open position of rig. 4.

In a further embodiment of the invention, the latch mechanism is eliminated and the hinge mechanism is modified such that microprocessor 25 or another control unit can, when desired, activate the hinge mechanism to move pivotally top 11 from the closed position of FIG. 1 to the open position of FIG. 4.

In another embodiment of the invention, the latch mechanism is eliminated and the hinge mechanism, although it continues to pivotally interconnect top 11 and bottom 12, is not spring loaded. Instead, the is a plunger or another mechanism which is, when desired, activated by microprocessor 25 or another control unit to produce a force which pivots top 11 about the hinge mechanism to move top 11 from the closed position of FIG. 1 to the open position of FIG. 4.

In still a further embodiment of the invention, the latch mechanism and the hinge mechanism are both removed. Top 11 simply sets on top of bottom 12. In one construct used in this embodiment, the upper edge 14 of bottom 12 and the lower edge 13 of top 11 (FIG. 1) are shaped and dimensioned to engage frictionally and removably one another, in the same manner that the opposing edges of the top and bottom of a hollow plastic "Easter egg" are shaped to frictionally engage each other so that the top of the plastic Easter egg engages the bottom of the plastic egg but can still be separated from the bottom of the egg.

As would be appreciated by those of skill in the art, the chronometer of the invention can be configured to recognize other events. In one embodiment, the chronometer is utilized to recognize and celebrate Christmas. The number of days remaining until Christmas are counted down on displays 16, 17, 18. On Christmas day, the top 11 opens or is opened to reveal, by way of example, a Santa Claus or a religious figure associated with or related to Christmas. In other embodiment, the chronometer is utilized to recognize and celebrate the birthday of an individual. The number of days remaining until Christmas are counted down on displays 16, 17, 18 and on the day of the birthday, the top 11 opens or is opened to reveal, by way of example, a birthday cake or picture of the individual whose birthday is being celebrated. The shape and dimension of the housing can be altered to correspond to the event being celebrated. By way of example, if the event is Christmas, then the housing can replicate a Christmas tree light or ornament.

Having described our invention in such terms as to enable those skilled in the art to make and use the invention, and having described presently preferred embodiments there of, we claim:

1. A method to recognize and celebrate a future birth of a baby, comprising the steps of (A) providing a chronometer to monitor the passage of time beginning months in advance of a projected date of birth of the baby, said chronometer comprising (1) a hollow free-standing housing including (a) a bottom including an upper edge, (b) a top including a lower edge, (c) a hinge mechanism rotatably connecting said top to said bottom such that said top moves between at least two operative positions, an open position, and a closed position, said upper edge and said lower edge shaped and dimensioned to conform to one another when said top and bottom are in said closed position to simulate a crack in an egg;

(2) an article mounted in said housing and viewable when said top is in said open position;

(3) a microprocessor mounted in said housing and programmable months in advance of the projected date of birth with a time period selected from a group consisting of days until the projected date of birth and of the projected data of birth; and (4) a display operatively associated with said microprocessor to indicate the length of time until the projected data of birth as a time period selected from a group consisting of days until the projected date of birth and of the projected date of birth;

(B) programming said microprocessor months in advance of the projected date of birth with a time period selected from a group consisting of days until the projected date of birth and of the projected date of birth; and, (C) moving said top near the projected date of birth to reveal at least partially said article;

said chronometer further comprising an apparatus mounted to the housing, which incrementally moves said top from said closed position to said open position such that said top stops at least once prior to completing the movement from said closed position to said open position on the projected date of birth.

* * * * *